US005161274A

United States Patent [19]

Hayes et al.

[11] Patent Number: 5,161,274

[45] Date of Patent: Nov. 10, 1992

[54] HOSPITAL BED WITH PROPORTIONAL HEIGHT KNEE BREAK

[75] Inventors: Stephen Hayes, Lower Gornal; Robert H. Jones, Tipton, both of England

[73] Assignee: J Nesbit Evans & Co. Ltd., United Kingdom

[21] Appl. No.: 785,269

[22] Filed: Oct. 30, 1991

[30] Foreign Application Priority Data

Feb. 6, 1991 [GB] United Kingdom ..... 9102518
Apr. 6, 1991 [GB] United Kingdom ..... 9107277

[51] Int. Cl.[5] ..... A61G 7/05
[52] U.S. Cl. ..... 5/618; 5/616
[58] Field of Search ..... 5/60, 66-69, 5/613-619

[56] References Cited

U.S. PATENT DOCUMENTS

| | | | |
|---|---|---|---|
| 2,517,466 | 8/1950 | Cox | 5/67 |
| 3,913,153 | 10/1975 | Adams | 5/66 |
| 4,227,269 | 10/1980 | Johnston | 5/68 |
| 4,361,917 | 12/1982 | Wilson | 5/68 |
| 4,385,410 | 5/1983 | Elliott | 5/67 |
| 4,435,862 | 3/1984 | King | 5/66 |
| 4,669,136 | 6/1987 | Waters | 5/66 |
| 4,862,530 | 9/1989 | Chen | 5/66 |
| 4,953,243 | 9/1990 | Birkmann | 5/66 |

*Primary Examiner*—Renee S. Luebke
*Assistant Examiner*—F. Saether
*Attorney, Agent, or Firm*—Learman & McCulloch

[57] ABSTRACT

An adjustable bed comprises a frame having a backrest arranged to be lifted by an actuator via a crank, and a thighrest similarly arranged to be lifted by an actuator. A legrest is freely pivoted to the thighrest. The angles of the parts are sensed and maintained in proportion by control means, so that as, for example, the backrest angle is steepened, the thighrest is also raised proportionately, but to less extent, taking the legrest with it.

3 Claims, 4 Drawing Sheets

HOSPITAL BED WITH PROPORTIONAL HEIGHT KNEE BREAK

This invention relates to beds especially but not exclusively nursing beds, hospital beds, and the like. It is known to make a so called profiling bed in which the mattress and its support are arranged so that a first portion can be upwardly inclined from a mid point to form a back rest, whilst a further portion is oppositely and upwardly inclined from that mid point as a thigh support, and yet a further part is downwardly inclined as a leg rest. The mattress may be flexible to enable this profiling to occur, or it may be made of a series of separate cushions. The mattress frame may comprise three, four or more parts which could be hinged together, and other arrangements are also possible to like effect. Angular adjustment of the individual parts above a normal co-planar flat condition, used for example for sleep, may be achieved by a series of struts, jacks, motors and the like. The normal method of control of these is entirely empiric, that is to say each motor or like is driven until the desired adjustment is achieved. Alternatively each motor may run until a stop is reached, that is to say the parts may be adjusted between the co-planar and flat position and a single profiled position.

The object of the invention is to provide improvements.

According to the invention a profiling bed is provided with a first motor for backrest adjustment and a second motor for legrest adjustment, both of the motors being reversible electric motors under the control of switch means arranged so that (optionally) operation of the first motor automatically causes a proportionate operation of the second motor in a like direction.

Hence, and for example, if the backrest is moved to incline to 45°, the thighrest and legrest may be moved to incline at say 20° (in opposite directions to one another) both angles being relative to the original planar position.

The controls for the motors may be mounted on the side of the bed so as to be operated by a person in the bed or may be on a hand-set located for use by such a person. Use of the invention will mean that when the backrest is increased in angle, because the patient wishes to sit up in bed, the thigh support and legrest will be raised so as to provide a so-called "knee break" which prevents the patient sliding down the bed.

It is preferred to arrange for the coupling of the two motors to be automatic, but to be capable of being overridden when required for example for therapeutic purposes, and when so overridden the two motors will be controlled separately and individually.

The control may be achieved by sensing the angles of the parts and comparing the sensed values with a memory and then adjusting the motors to make any required correction.

Angle sensing may be achieved using level switches having parts turned angularly with or by the moved parts of the bed, for example mercury switches or rotary potentiometers, or for example by sensing the displacement achieved by the motors.

In one possibility the motors may be electric motors driving screw and nut mechanisms, for example using recirculating ball nuts so that the screw is extended as a jack to bring about the raising of a bed part, and retracted to lower the same, in which case the axial position of the extended part may be sensed or the rotation of the nut may be sensed to provide the electronic value of the angular displacement affected.

One presently preferred embodiment of the invention is now more particularly described with reference to the accompanying drawings wherein.

Figure 1:
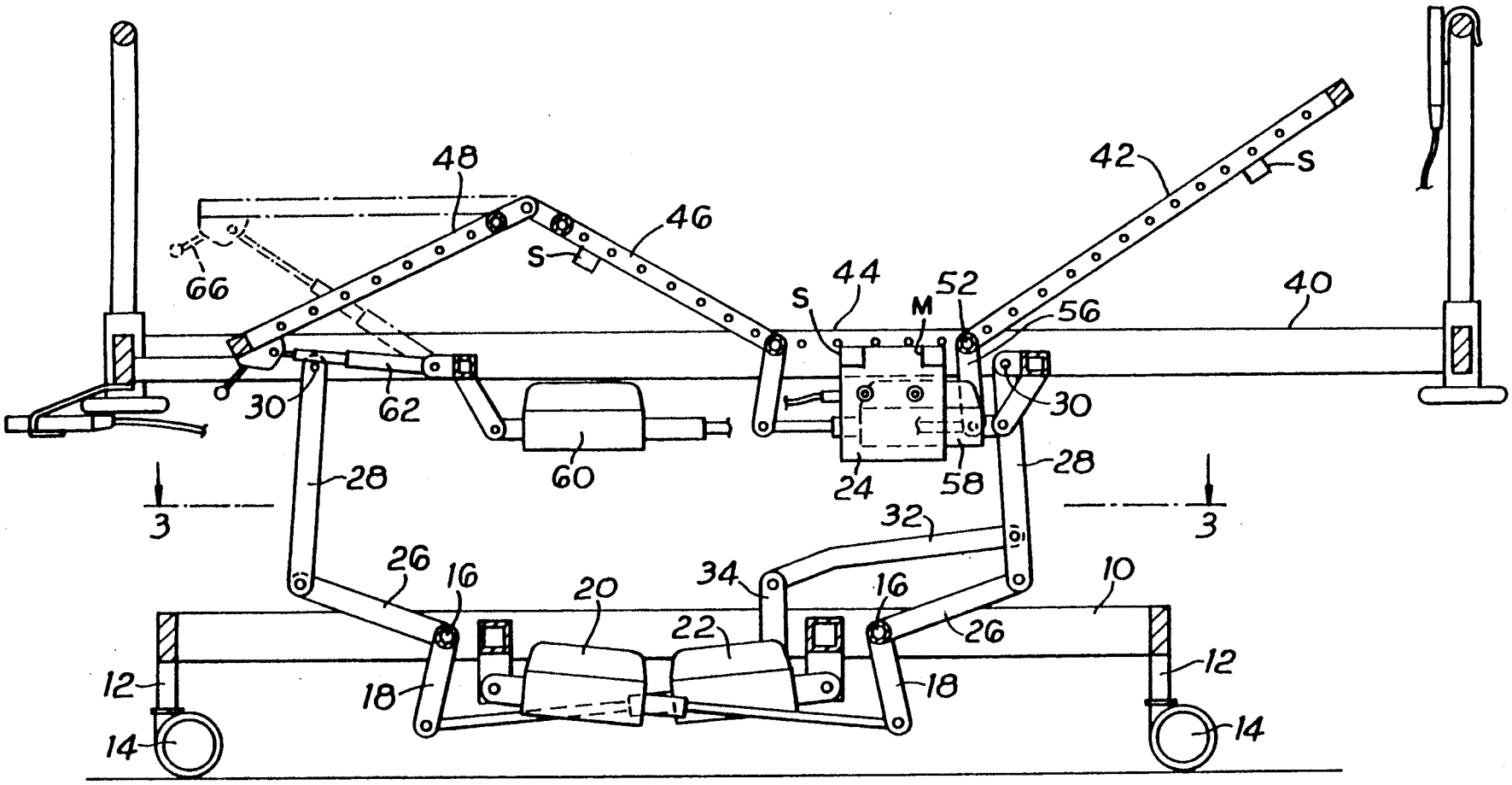
FIG. 1 is a somewhat diagrammatic and fragmentary sectional elevation of a bed in a typical profiled position.

Turning now to the drawings, the bed therein shown comprises a chassis frame 10 provided with legs 12 at each corner and with a wheel or castor 14 and braking means therefor on each leg.

A pair of transversely extending main shafts 16 is provided which are journalled on parallel axes in bushes in the chassis frame. Each shaft has an for example downwardly extending crank arm 18, and each crank arm is pinned to the end of the rod of a corresponding actuator 20,22. The two (the first two) actuators are mounted on brackets on opposite sides of the chassis and connected to suitable power supplies and to a central proportional control box 24 as explained hereinafter.

Both of the actuators may comprise a low voltage reversible electric motor coupled to a recirculating ball nut mechanism arranged so that the power supply in one direction extends the rod of the actuator in a direction which (as later explained) causes elevation of a bed part, and power supply in the opposite direction causes the reverse movement; no power causes the actuator to lock in the adjusted position.

Each shaft also has a pair of radius arms 26 fast therewith at axially spaced positions. The ends of the arms are connected to hinge points on a mattress frame via interposed links 28. Hence the mattress frame is carried at four spaced hinge points 30. The mattress frame can be elevated or lowered and maintained level or tilted in either direction (head or foot) by appropriate operation of the first two actuators.

One or preferably one pair of radius arms 28 is connected in a parallelogram linkage by a swinging tie 32 pivoted to a fixed bracket 34 on the chassis and to the corresponding link (s) as a control on position.

Figure 2:
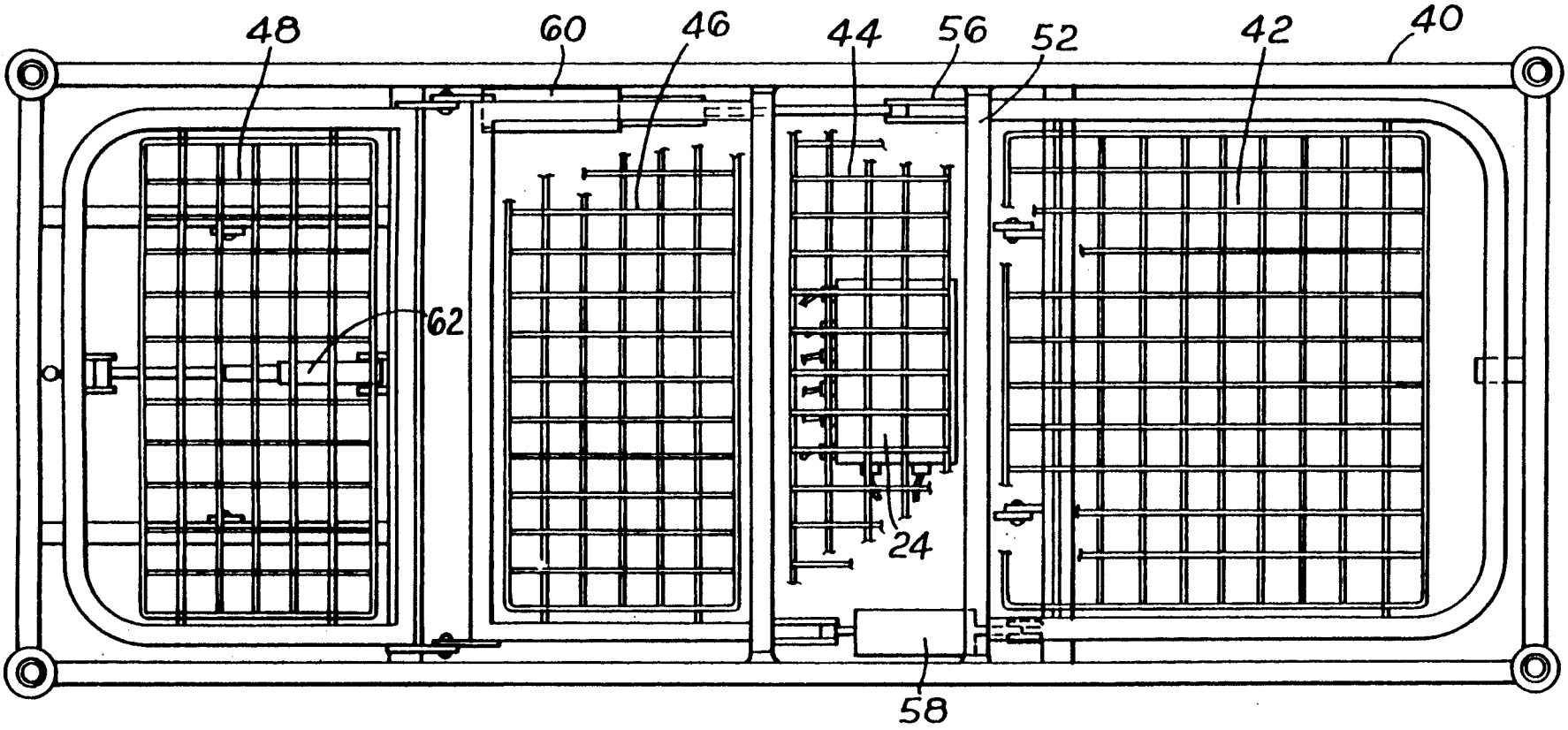
FIG. 2 is a plan view of the same but in a flat condition.
Figure 3:
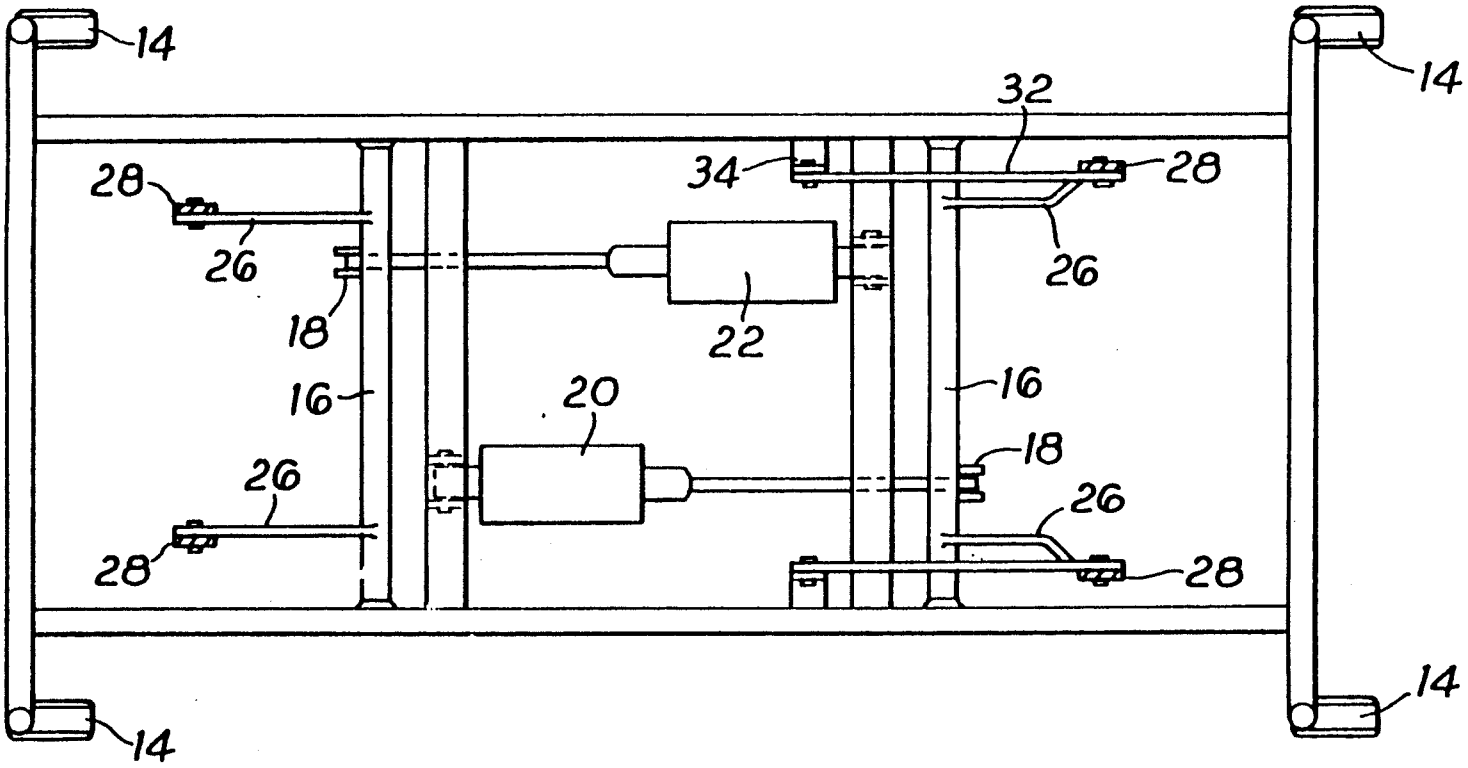
FIG. 3 is a sectional plan view taken on the line 3—3 FIG. 1.

The mattress frame 40 which may be skeletal or a complete peripheral frame corresponding in dimensions to the complete mattress comprises four sections (FIG. 2) located end-to-end and called for convenience a backrest 42, a base 44, and a legrest portion having thighrest 46 and legrest 48 sections. Each section may comprise a wire grid panel to support a corresponding area of the mattress or a separate 'biscuit' mattress cushion.

The base 44 is fixed in position on the mattress frame. The backrest 42 is hinged at one end of the base for movement about a lateral axis 52, i.e. parallel to the main shaft axis, and has a like crank 56 pinned to the rod of a third actuator 58 which is mounted on the mattress frame. The backrest 42 is provided with a known level sensor S for sensing the angle of the backrest 42 in relation to the frame. The level sensor S may be a known level switch having parts turned angularly in response to movement of the backrest 42. The switch may include a mercury switch or a rotary sensor or may comprise a sensor for sensing the displacement of the backrest actuator 58. The thighrest 46 is hinged in similar fashion at the opposite end of the base and similarly connected to a fourth actuator 60. The legrest 48 is hinged to the thighrest 46 and a gas spring 62 is disposed between the legrest and the mattress frame, so that as the fourth actuator swings the thighrest to an inclined position relative to the mattress frame (FIG. 1, full-line position) the gas spring maintains the legrest parallel to the mattress frame (chain-dot line position). However a release catch 66 and mechanism is provided allowing the legrest angle to be adjusted relative to the gas strut, allowing the gas strut to maintain the adjusted angle as the thighrest is adjusted by the fourth actuator. The legrest portion is also provided with a level sensor S like that described with reference to the backrest 42 and operates in a similar manner to sense the angular position of the thighrest and legrest sections 46, 48. These sensors S are operatively coupled in known manner to the central proportional control box 24 for comparing the sensed valves with a conventional microprocessor memory M to effectuate proportional movement of the backrest 42 and legrest portions by controlled operation of the third and fourth actuators 58, 60.

The third and fourth actuators may be similar to those used as the first and second actuators; preferably however they are arranged to be power driven to extend the actuator and steepen the angle of the part connected thereto, and to lock when there is no power. (And in these respects are identical to the first and second actuators). However when power is applied in the opposite direction these third and fourth actuators they may unlock but allow a controlled descent under force applied to the part by gravity or the bed occupant, but not positively driven in the descent direction. Moreover it is preferred that the rod should be always freely displaceable from the adjusted position in a further extended direction and the word 'lock' simply means that movement in the opposite direction i.e. contraction of the actuator, is prevented. Actuators having all of these features and of both of these types i.e. the first and second actuator type and the third and fourth actuator type, are commercially available from a number of sources and need no further description to those skilled in the art.

The control box may house a level sensor S which is gravity operated. In this embodiment (not illustrated) it comprises a freely pivoted plate bearing indications, for example printed lines which move across a read-head when the head changes position as it moves with the mattress frame. Thus if the mattress frame is level and is lifted or lowered without tilt the read-head remains in constant position relative to the said plate, but if tilt occurs, the plate effectively swings under gravity so as to remain in constant position relative to the ground whilst the read-head moves over it. This sends pulses via a counter to the microprocessor M in the control box.

Figure 4:
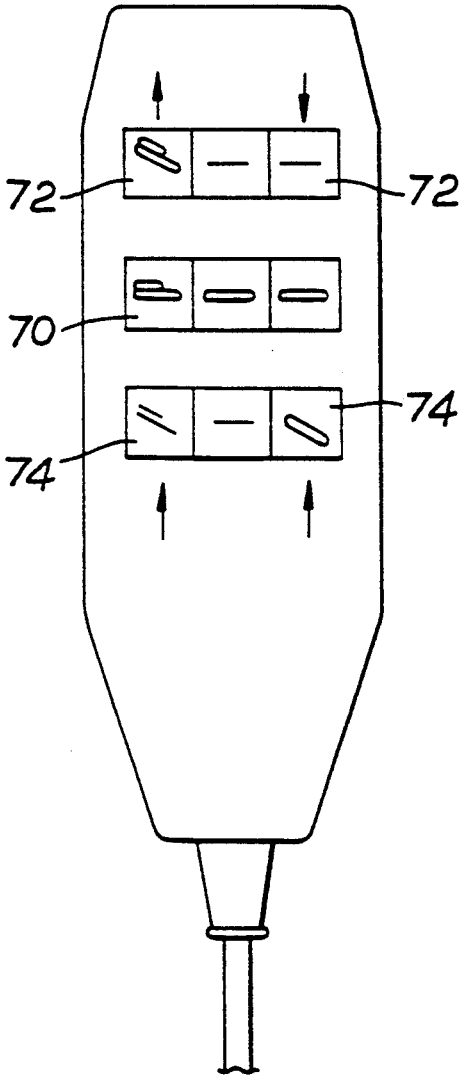
FIGS. 4 and 5 show a pair of hand sets for use in controlling the bed.

The bed preferably has two hand controls. One, FIG. 4, which may be positioned for use by the occupant (for example patient) may have a first pair of buttons 70 connected via the microprocessor to the first pair of actuators and arranged to vary the height of the bed, for example between the position last selected for nursing purposes and one convenient to the patient, for getting in and out of bed or for social intercourse with a visitor.

During height adjustment, variations in load for example due to a visitor (perhaps inadvisedly) sitting on the foot of the bed, would tend to bring about unwanted tilt, or unwanted adjustment of tilt. This variation in angle is sensed by the said plate and the microprocessor adjusts the current supply to the first pair of actuators to restore the wanted condition.

The occupant's hand set controller may also have a like pair of buttons 72 for causing upwards or downward movement by the third actuator (backrest angle control). These movements, or more specifically the current flow/direction/time are effectively used by the microprocessor to initiate the proportional movement of the fourth actuator. That is to say each backrest adjustment brings about a similar but smaller legrest adjustment.

A third pair of buttons 74 on the occupant's hand set may control the legrest, that is the fourth actuator independently and separately.

Figure 5:
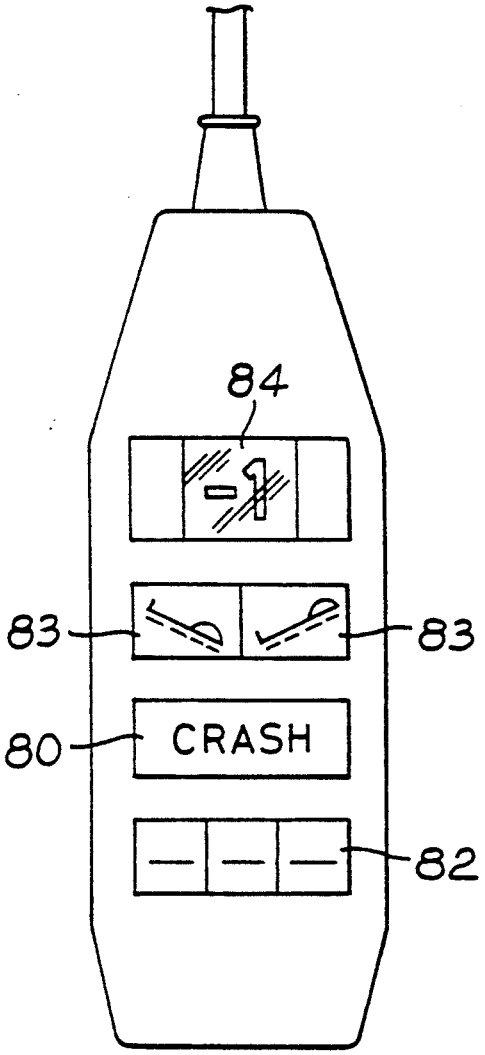

The second hand set FIG. 5, which may be located in a position normally inaccessible to the occupant is for nursing use. It may have a 'crash button' 80 used via the microprocessor to bring about rapid restoration to zero tilt and perhaps zero raised condition of all parts. This hand set also has buttons 82 83 respectively to control and adjust height and tilt of the mattress frame as a whole, with possibly a numerical read-out display 84 of the tilt angle. The microprocessor is arranged so that there is an automatic pause in actuator energisation whenever the mattress frame tilts to zero angle, i.e. level condition. This avoids overshoot.

Tilting is brought about in general by movement of the first and second actuators in opposite directions, unless either reaches or is at a limit of displacement or any obstacle prevents further movement in a desired direction.

The second hand set may if desired include a further control which is a lock-out, preventing operation by the patient's hand set and effective on any or all of the first hand set controls.

We claim:

1. An adjustable bed assembly comprising:

a mattress frame having a backrest portion and a legrest portion independently hinged to said frame for angular movement relative to said frame;

first reversible motor means interconnecting said backrest portion and said frame for causing said angular movement thereof;

second reversible motor means interconnecting said legrest portion and said frame for causing said angular movement thereof; and proportional control means for simultaneously controlling operation of said first and second motor means to cause said backrest portion to pivot with a proportionately greater rate of angular displacement than said legrest portion.

2. An assembly as claimed in claim 1 wherein said control means includes means for sensing the angular positions of the backrest and legrest portions, comparing the sensed positions with a memory, and adjusting said motors to make any required correction.

3. An assembly as claimed in claim 2 wherein said means for sensing the angular positions comprises level switches responsive to the angular movement of said backrest and legrest portions.

* * * * *